US012453369B1

(12) United States Patent
Chen

(10) Patent No.: US 12,453,369 B1
(45) Date of Patent: Oct. 28, 2025

(54) ATOMIZER POT AND ELECTRONIC HOOKAH

(71) Applicant: Shenzhen Impetus Technology Co., Ltd., Guangdong (CN)

(72) Inventor: Liqian Chen, Guangdong (CN)

(73) Assignee: Shenzhen Impetus Technology Co., Ltd., Shenzhen (CN)

( * ) Notice: Subject to any disclaimer, the term of this patent is extended or adjusted under 35 U.S.C. 154(b) by 0 days.

(21) Appl. No.: 19/026,893

(22) Filed: Jan. 17, 2025

(30) Foreign Application Priority Data

Apr. 26, 2024 (CN) ..... 202410515425.X

(51) Int. Cl.
*A24F 1/30* (2006.01)
*A24F 40/485* (2020.01)

(52) U.S. Cl.
CPC ..... *A24F 1/30* (2013.01); *A24F 40/485* (2020.01)

(58) Field of Classification Search
None
See application file for complete search history.

(56) References Cited

U.S. PATENT DOCUMENTS

2013/0330680 A1* 12/2013 Bavar ..... A24F 1/30 432/225

FOREIGN PATENT DOCUMENTS

WO WO-2018107495 A1 * 6/2018 ..... A24F 1/30
WO WO-2024156327 A1 * 8/2024

OTHER PUBLICATIONS

What is a Hookah Heat Management Device or HMD, Clay Boyles, pp. 1-7, https://web.archive.org/web/20240127170448/https://www.hookah-shisha.com/blog/what-is-a-heat-management-device-hookah (Year: 2024).*
WO2024156327A1 English Translation obtained from Esapcenet, pp. 1-19 (Year: 2024).*
WO2018107495A1 English Translation obtained from Espacenet, pp. 1-5 (Year: 2018).*

* cited by examiner

*Primary Examiner* — Philip Y Louie
*Assistant Examiner* — Madeleine P Delacruz

(57) ABSTRACT

Disclosed is an atomizer pot and an electronic hookah. The atomizer pot includes: a pot body and a pot cover adapted to the pot body, which form a cavity for containing a smoking material and are both provided with air passing holes. When the atomizer pot is heated, the smoking material is insulated by the pot body, and hot air enters the smoking material from the air passing holes. With the atomizer pot of the present disclosure, the problem that "a container unevenly heated and storing a smoking device is integrated with a water pipe smoking device, which is difficult for daily cleaning" is solved, facilitating loading of smoking materials and cleaning of the atomizer pot. Meanwhile, the atomizer pot is heated upside down. The smoking material does not directly contact the high temperature, thus avoiding the problem of the smoking material being burnt.

14 Claims, 10 Drawing Sheets

ATOMIZER POT AND ELECTRONIC HOOKAH

CROSS REFERENCE TO RELATED APPLICATIONS

The present application claims the benefit of Chinese Patent Application No. 202410515425.X filed on Apr. 26, 2024, the contents of which are incorporated herein by reference in their entirety.

TECHNICAL FIELD

The present disclosure relates to the technical field of hookahs, and in particular, to an atomizer pot and an electronic hookah.

BACKGROUND

The most common electronic hookah on the market is mainly a baking-type water pipe smoking device. The baking-type water pipe smoking device is usually provided with smoking materials such as tobacco on a top part and water on a bottom part. When this device is in use, heated charcoal is placed on the tobacco to directly heat the tobacco to produce smoke, which is then filtered through water and finally smoked by a straw.

However, this baking-type water pipe smoking device currently on the market cannot control a temperature at which tobacco is heated. If the temperature of charcoal is too high, the tobacco is burnt; if the temperature of charcoal is too low, an amount of smoke is insufficient. Meanwhile, a container for storing a smoking device is integrated with a water pipe smoking device, which is difficult for daily cleaning.

SUMMARY

In view of the above problems, embodiments of the present disclosure are proposed to provide an atomizer pot and an electronic hookah, which overcome the above problems or at least partially solve the above problems.

An atomizer pot includes a pot body and a pot cover adapted to the pot body;

the pot body and the pot cover form a cavity for containing a smoking material; the pot body and the pot cover are both provided with air passing holes; the pot body is made of a thermally conductive material; and when the atomizer pot is heated, the smoking material is insulated by the pot body, and hot air enters the smoking material from the air passing hole.

Preferably, a heat distribution structure is provided in the cavity.

Preferably, the heat distribution structure includes a convex part for heat transfer and a concave part for air intake, and a height of the convex part is greater than that of the concave part; and the convex parts and the concave parts are alternately arranged.

Preferably, a heat-relief sheet is arranged inside the pot body; and a shape of the heat-relief sheet is adapted to that of the pot body.

Preferably, the atomizer pot further includes an air passing pipe, wherein the air passing pipe is arranged in the cavity and connected to a top part of the pot body.

Preferably, a heat-relief sheet is arranged around the air passing pipe.

Preferably, the pot body has a thickness of 0.4-3 mm.

Preferably, the pot body has a thermal conductivity of 20-600 W/(m.K).

Preferably, the pot body includes a top part and a side wall extending around an edge of the top part; and the side wall and the top part form a cavity for containing the smoking material.

Preferably, the pot cover is detachably mounted at one end of the side wall far away from the top part, the pot cover covers an opening and is positioned at a bottom part of the pot body, and the top part is heated to generate heat.

Preferably, a shape of the heat-relief sheet is adapted to that of the top part.

The present disclosure further includes an electronic hookah, wherein the electronic hookah includes a main unit and the atomizer pot, and the atomizer pot is arranged in the main unit.

The present disclosure specifically includes the following advantages:

In the embodiments of the present disclosure, compared with the prior art that "a container unevenly heated and storing a smoking device is integrated with a water pipe smoking device, which is difficult for daily cleaning", the present disclosure provides a solution of "individually designing an atomizer pot", which specifically includes a pot body and a pot cover adapted to the pot body; the pot body and the pot cover form a cavity for containing a smoking material; the pot body and the pot cover are both provided with air passing holes; the pot body is made of a thermally conductive material; and when the atomizer pot is heated, the smoking material is insulated by the pot body, and hot air enters the smoking material from the air passing hole. According to the pot body and the pot cover forming a cavity for containing a smoking material solved, the problem that "a container unevenly heated and storing a smoking device is integrated with a water pipe smoking device, which is difficult for daily cleaning" is solved, and this facilitates the loading of smoking materials and the cleaning of the atomizer pot. Meanwhile, when the atomizer pot is heated, the pot cover is at a bottom and the pot body is at a top. The pot body is heated, so the atomizer pot is heated upside down. The smoking material does not directly contact the high temperature, thus avoiding the problem of the smoking material being burnt.

BRIEF DESCRIPTION OF DRAWINGS

To describe the technical solutions in the present disclosure more clearly, the following briefly describes the accompanying drawings for describing the present disclosure. Apparently, the accompanying drawings in the following description show some embodiments of the present disclosure, and those of ordinary skill in the art may still derive other drawings from these accompanying drawings without creative efforts.

Figure 1:
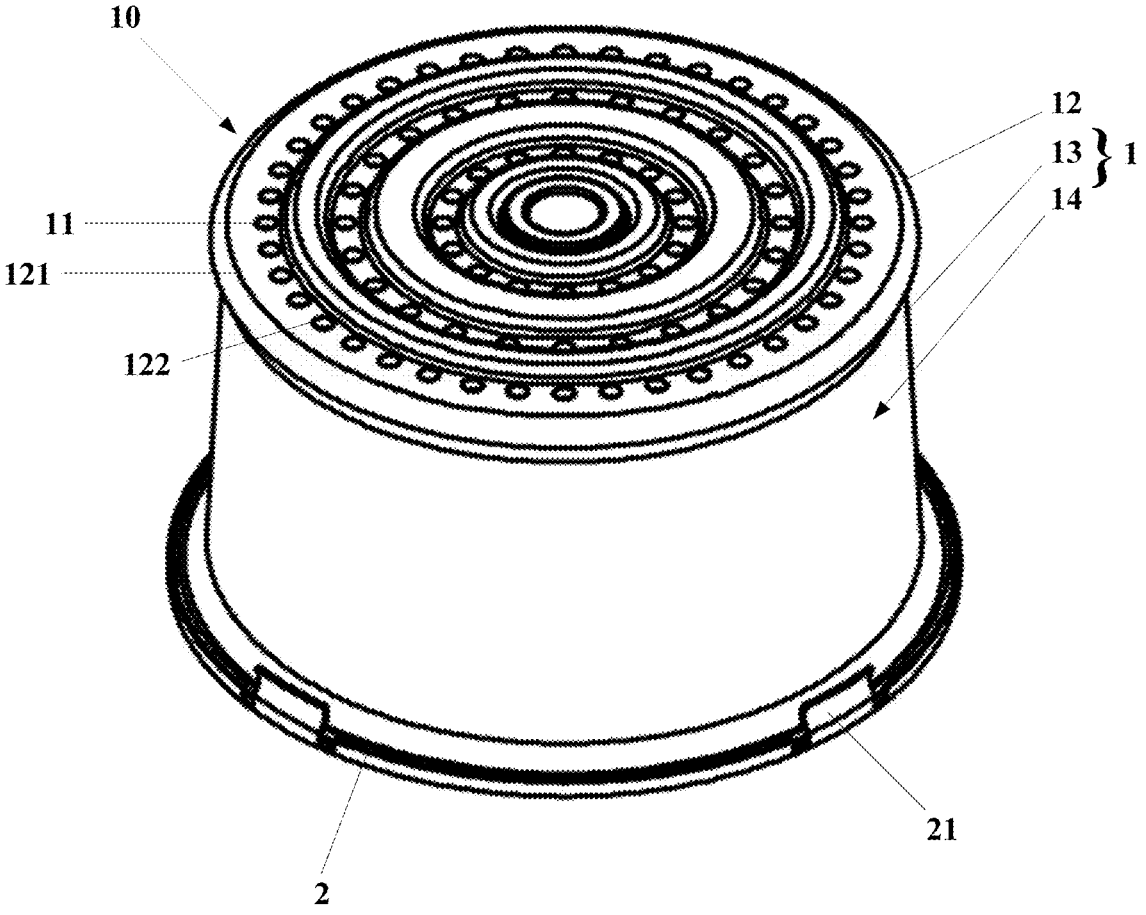
FIG. 1 is a first perspective view of an atomizer pot according to the present disclosure.

1000: electronic hookah; 14: cavity; 300: container; 121: concave part; 301: mouthpiece; 122: convex part; 201: electric heating component; 123, 1012: air passing pipe; 202: main unit; 124: rivet; 100: smoking material pot; 141: opening; 10, 101, 200: atomizer pot; 142, 102: smoking material; 1, 1013: pot body; 21: engaging part; 2, 1014: pot cover; 31: mesh bottom; 3, 1011: mesh sheet; 32: mesh edge; 11: air passing hole; 33: arc-shaped through hole; 12: top part; 34: mounting hole; 13: side wall; and 20': heating device.

DETAILED DESCRIPTION

To make the objectives, features, and advantages of the present disclosure more apparent and understandable, the following describes the present disclosure in detail with reference to the accompanying drawings and specific implementations. It is clear that the described embodiments are merely some but not all of embodiments of the present disclosure. All other embodiments obtained by those of ordinary skill in the art based on embodiments of the present disclosure without creative efforts shall fall within the protection scope of the present disclosure.

The inventors have found through analysis of the prior art that the most common electronic hookah on the market is mainly a baking-type water pipe smoking device. The baking-type water pipe smoking device is usually provided with smoking materials such as tobacco on a top part and water on a bottom part. When this device is in use, heated charcoal is placed on the tobacco to directly heat the tobacco to produce smoke, which is then filtered through water and finally smoked by a straw. However, this baking-type water pipe smoking device currently on the market cannot control a temperature at which tobacco is heated. If the temperature of charcoal is too high, the tobacco is burnt; if the temperature of charcoal is too low, an amount of smoke is insufficient. Meanwhile, a container for storing a smoking device is integrated with a water pipe smoking device, which is difficult for daily cleaning.

To solve the above technical problems, an atomizer pot adopted by the present disclosure includes a pot body 1 and a pot cover 2, wherein the pot body is provided with a plurality of air passing holes 11 and includes a top part 12, a side wall 13 extending around an edge of the top part, and a cavity 14 having an opening and enclosed by the top part 12 and the side wall 13, and the cavity 14 is used to loading a smoking material 142; the pot cover 2 is detachably mounted at one end of the side wall 13 far away from the top part 12, the pot cover 2 covers the opening and is positioned at a bottom part of the pot body 1, and the top part 12 is heated to generate heat, so that the heat is conducted to the pot cover 2 by the side wall 13.

Referring to FIG. 1, a schematic structural diagram of an atomizer pot according to the present disclosure is shown. The atomizer pot may specifically include the following structures: a pot body and a pot cover adapted to the pot body; the pot body and the pot cover form a cavity for containing a smoking material; the pot body and the pot cover are both provided with air passing holes; the pot body is made of a thermally conductive material; and when the atomizer pot is heated, the smoking material is insulated by the pot body, and hot air enters the smoking material from the air passing hole.

In the embodiments of the present disclosure, compared with the prior art that "a container unevenly heated and storing a smoking device is integrated with a water pipe smoking device, which is difficult for daily cleaning", the present disclosure provides a solution of "individually designing an atomizer pot", which specifically includes a pot body and a pot cover adapted to the pot body; the pot body and the pot cover form a cavity for containing a smoking material; the pot body and the pot cover are both provided with air passing holes; the pot body is made of a thermally conductive material; and when the atomizer pot is heated, the smoking material is insulated by the pot body, and hot air enters the smoking material from the air passing hole. According to the pot body and the pot cover forming a cavity for containing a smoking material solved, the problem that "a container unevenly heated and storing a smoking device is integrated with a water pipe smoking device, which is difficult for daily cleaning" is solved, and this facilitates the loading of smoking materials and the cleaning of the atomizer pot. Meanwhile, when the atomizer pot is heated, the pot cover is at a bottom and the pot body is at a top. The pot body is heated, so the atomizer pot is heated upside down. The smoking material does not directly contact the high temperature, thus avoiding the problem of the smoking material being burnt.

Next, an atomizer pot in this exemplary embodiment is further described.

In an embodiment of the present disclosure, the atomizer pot includes a pot body 1 and a pot cover adapted to the pot body 1; wherein the pot cover 2 may have the same shape as the pot body 1, an area of the pot cover 2 may also be greater than that of an opening of the pot body 1, the pot cover 2 may also be detachably connected to the pot body 1, and the pot cover 2 may also be fixedly connected to the pot body 1.

In a specific embodiment, the heat of the pot body 1 mainly plays a role in keeping warm or maintaining constant temperature of the smoking material 142, the pot body 1 can maintain the temperature of the smoking material 142 within a relatively stable range, so as to ensure the atomization effect of the smoking material 142, the top part 12 of the pot body 1 effectively transfers the heat of a heating component to the entire pot body 1 through plane contact, which is specifically a principle of heat conduction. The heating component is mounted on the top part 12 of the pot body 1, the heat is effectively transferred to the entire pot body 1 through the plane contact, and the heat transfer mode can ensure that all parts of the pot body can be uniformly heated.

As an example, when the area of the pot cover 2 is greater than that of the opening of the pot body 1, a buckle is provided on one side of the pot cover 2 facing the pot body 1, and the pot cover 2 is buckled with the pot body 1. A material of the pot cover 2 is the same as that of the pot body 1, and may also be different from that of the pot body 1.

In a specific embodiment, the pot cover 2 is circular, and the area of the pot cover 2 is slightly greater than that of the opening of the pot body 1, so as to cover the pot body 1.

In an embodiment of the present disclosure, the pot body 1 and the pot cover 2 form a cavity for containing a smoking material 142; the pot body 1 may be square or circular and may be customized based on a requirement of a user, and a shape of the pot body 1 is not limited. In an embodiment of the present disclosure, the pot body 1 and the pot cover 2 are both provided with air passing holes 11; the air passing holes 11 of the pot cover 2 are circular, a plurality of the air passing holes 11 are provided, and the air passing holes 11 are arranged at equal intervals.

As an example, the pot body 1 includes a top part 12, a side wall 13 extending around an edge of the top part 12, and a cavity 14 having an opening 141 and enclosed by the top part 12 and the side wall 13, and the air passing holes 11 of the pot body 1 are arranged on the top part of the pot body 1. The cavity 14 is used to store a smoking material 102. The air passing holes 11 are used for hot air to enter.

In a specific embodiment, the pot body 1 is made of a thermally conductive material; the material of the pot body 1 can be a material which is easy to conduct heat and store heat, such as a stainless steel material. There are many metal materials that are easy to conduct heat and store heat. The following are some common materials, for example, copper is a very good thermally conductive material and is widely used in electronic radiators and heat sinks. Alternatively, aluminum has thermal conductivity second to copper, has a lighter weight and lower cost, and thus is widely used in heat sinks and other places where efficient heat dissipation is required. Titanium is not as thermally conductive as copper and aluminum, but is lightweight, strong, and corrosion resistant, and thus is commonly used in aerospace and other applications where high strength and lightweight are required.

When the atomizer pot is heated, heat is uniformly conducted to the smoking material 142 through the pot body 1, and the smoking material 142 generates gas and is discharged from the air passing holes 11.

In an embodiment of the present disclosure, a heat distribution structure is provided in the cavity, the heat distribution structure includes a convex part for heat transfer and a concave part for air intake, and a height of the convex part 122 is greater than that of the concave part 121; and the convex parts 122 and the concave parts 121 are alternately arranged.

In a specific embodiment, the convex part 122 and the concave part 121 constitute a heat distribution structure. To enable the smoking material 142 in the cavity 14 to be heated more uniformly, the convex part 122 and the concave part 121 arranged to be heated uniformly refer to the top part 12 that can receive heat uniformly in all parts during the heating process, so as to ensure that the material is heated uniformly, thereby improving the processing quality and efficiency. The uniformly heated top part 12 enables better heat transfer into the material, reduces heat loss, and improves heating efficiency. With the uniform heating, the temperature gradient within the material is reduced, which reduces the possibility of thermal stress and non-uniform shrinkage, thereby improving the quality and uniformity of the material. The uniform heating avoids material deformation due to local overheating, which is important for upgrade of the smoking material 142. The convex part 122 and the concave part 121 arranged to be heated uniformly have an important role in the application of the present disclosure, and can significantly improve the upgraded quality of the smoking material 142, so that the taste is better.

In an embodiment of the present disclosure, a heat-relief sheet is arranged inside the pot body 1; and a shape of the heat-relief sheet 1 is adapted to that of the pot body. A heat-relief sheet is arranged around the air passing pipe 123.

In a specific embodiment, the heat-relief sheet is specifically a mesh sheet 3, and the mesh sheet 3 is circular. The atomizer pot further includes an air passing pipe 123, wherein the air passing pipe 123 is arranged in the cavity 14 and connected to a top part 12 of the pot body 1. The air passing pipe 123 is preferably arranged in the middle of the top part 12, and a plurality of the air passing pipes 123 may be provided, and one end of the air passing pipe 123 is connected to the top part 12. The air passing pipe 123 is a hollow cylinder, and an air passing hole 11 is also provided on the air passing pipe 123. A plurality of the heat-relief sheets or a single heat-relief sheet are arranged around the air passing pipe 123.

In an embodiment of the present disclosure, the pot body 1 has a thickness of 0.4-3 mm, the thickness of the pot body 1 may be 0.4 mm, the thickness of the pot body 1 may be 0.6 mm, the thickness of the pot body 1 may be 0.8 mm, the thickness of the pot body 1 may be 1 mm, the thickness of the pot body 1 may be 1.3 mm, the thickness of the pot body 1 may be 1.4 mm, the thickness of the pot body 1 may be 1.5 mm, the thickness of the pot body 1 may be 1.8 mm, the thickness of the pot body 1 may be 2 mm, the thickness of the pot body 1 may be 2.5 mm, and the thickness of the pot body 1 may be 3 mm.

In an embodiment of the present disclosure, the pot body 1 has a paste-loading capacity of 5-25 grams, which may be 5 grams, 10 grams, 15 grams, 20 grams, or 25 grams.

In an embodiment of the present disclosure, the pot body 1 has a thermal conductivity of 20-600 W/(m.K). The thermal conductivity of the pot body 1 may be 20 W/(m.K), the thermal conductivity of the pot body 1 may be 50 W/(m.K), the thermal conductivity of the pot body 1 may be 100 W/(m.K), the thermal conductivity of the pot body 1 may be 200 W/(m.K), the thermal conductivity of the pot body 1 may be 300 W/(m.K), the thermal conductivity of the pot body 1 may be 400 W/(m.K), the thermal conductivity of the pot body 1 may be 500 W/(m.K), and the thermal conductivity of the pot body 1 may be 600 W/(m.K). Specifically, the pot body 1 may be made of stainless steel, aluminum alloy, brass, copper, alumina ceramic, silicon carbide, zirconium oxide, silicon nitride, sapphire, and the like. The stainless steel has a thermal conductivity of 16-25 W/(m.K), the aluminum alloy has a thermal conductivity of 237 W/(m.K), the brass has a thermal conductivity of 70-183 W/(m.K), the copper has a thermal conductivity of 400 W/(m.K), the alumina ceramic has a thermal conductivity of 30 W/(m.K), the silicon carbide has a thermal conductivity of 120-490 W/(m.K), the zirconium oxide has a thermal conductivity of 2 W/(m.K), the silicon nitride has a thermal conductivity of 17-25 W/(m.K), and the sapphire has a thermal conductivity of 132-200 W/(m.K).

An embodiment of the present disclosure provides an electronic hookah, wherein the electronic hookah 1000 includes a main unit 202 and the atomizer pot 10, and the atomizer pot 10 is arranged in the main unit 202. Specifically, the electronic hookah includes a main unit 202. The main unit 202 is provided with an air outlet hole, the main unit 202 may be externally connected to a container through the air outlet hole, and the container is filled with edible filtrate and is provided with a straw for suction. The electronic hookah 1000 also includes an electric heating component arranged on the main unit 202 and the atomizer pot 10 detachably mounted on the main unit 202, and the atomizer 10 is used to mount a smoking material 142. The atomizer 10 is heated by the electric heating component to heat the smoking material 142 to form smoke, and the smoke is output from the air outlet hole to the container for the user to inhale through the straw.

Figure 2:
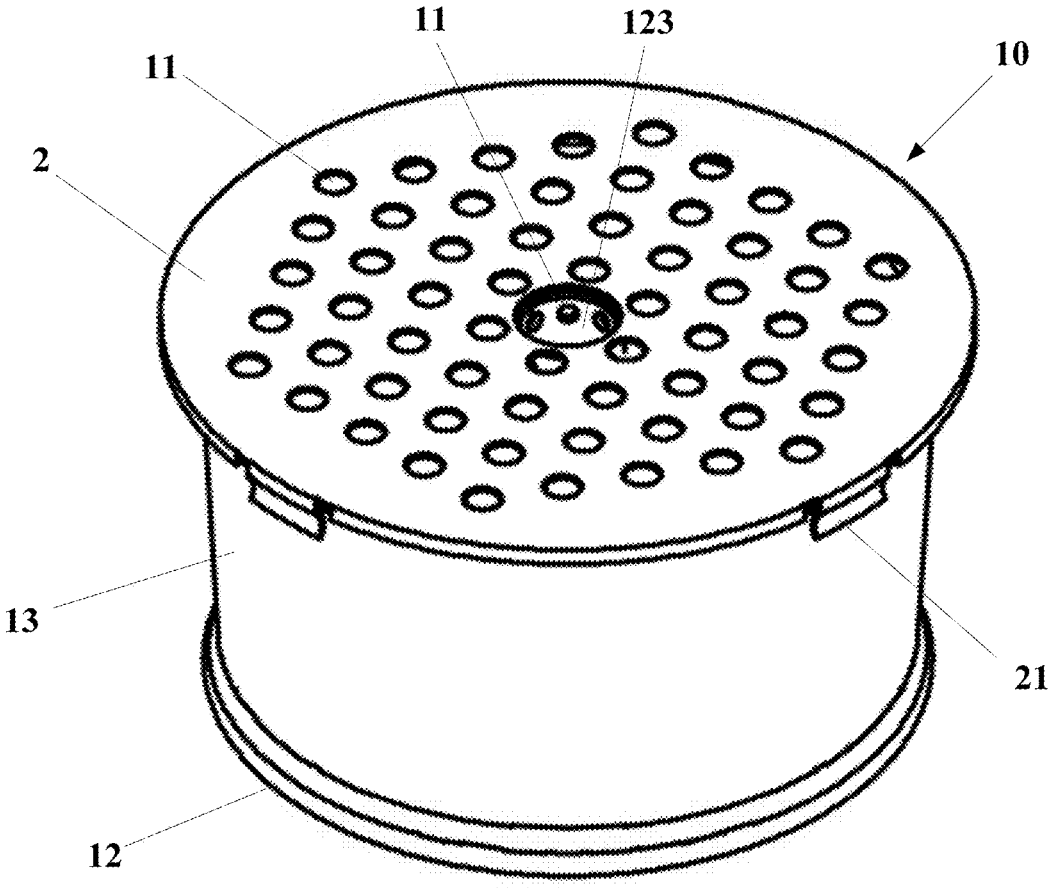
FIG. 2 is a second perspective view of an atomizer pot according to the present disclosure.

Referring to FIGS. 1 and 2, FIGS. 1 and 2 show a structure of an atomizer pot according to an embodiment of the present disclosure from different angles. The present disclosure provides an atomizer pot 10. The atomizer pot 10 is mounted to a smoking device, such as an electronic hookah. The atomizer pot 10 is used to store a smoking material and produce smoke for a user to inhale. The atomizer pot 10 provided by the present disclosure may fully atomize the smoking material under the heated condition, and meanwhile, the smoking material is not burnt due to excessive heating, so that the smoke quality is improved.

The present disclosure further includes an electronic hookah, wherein the atomizer pot 10 is arranged in the main unit, and the atomizer pot 10 may be fixedly arranged in the main unit. Preferably, the atomizer pot 10 may also be detachably connected to the main unit.

Figure 3:
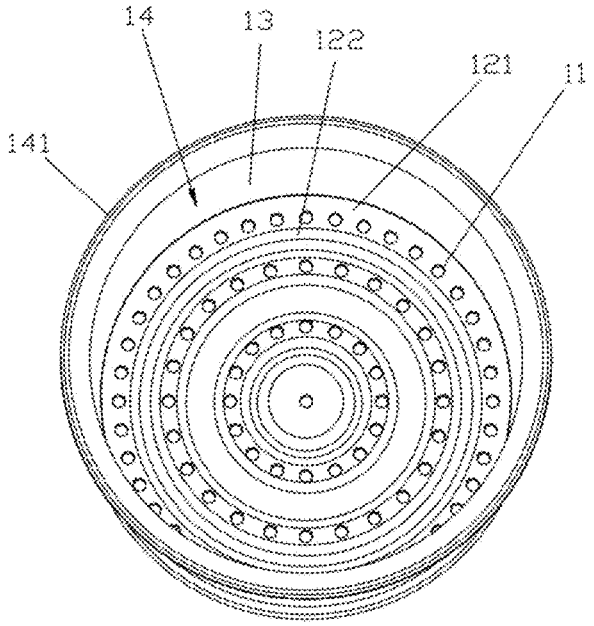
FIG. 3 is a schematic structural diagram of a pot body of an atomizer pot according to the present disclosure.

Referring to FIG. 3, the atomizer pot 10 includes a pot body 1 and a pot cover 2. The pot body 1 may be made of a material that is easy to conduct heat and store heat, such as stainless steel. The pot body 1 is provided with a plurality of air passing holes 11. The pot body 1 includes a top part 12, a side wall 13 extending around an edge of the top part 12, and a cavity 14 having an opening 141 and enclosed by the top part 12 and the side wall 13. The air passing holes 11 are used to guide air outside the atomizer pot 10 to the cavity 14 and guide air in the cavity 14 to the outside of the atomizer pot 10. The top part 12 is heated by a heating device to generate heat. The heating device is positioned outside the atomizer pot 10, and the heating device is mounted on a smoking device on which the atomizer pot 10 is mounted, and may be a heating assembly such as an electric heating component. The present disclosure contains the smoking material by using the cavity 14. The pot cover 2 covers the cavity 14, so that the smoking material is confined in the atomizer pot 10. Since the side wall 13 is formed by extending around an edge of the top part 12, the top part 12 transfers heat to the side wall 13 after being heated, so that the smoking material contacting the side wall 13 is heated to generate smoke, which not only increases a heating area of the smoking material loaded in the cavity 14, but also prevents the smoking material from being partially burned due to excessive heating.

In a specific embodiment, the pot cover 2 is detachably mounted on one end of the side wall 13 far away from the top part 12, and the pot cover 2 covers the opening 141. When the top part 12 is heated and conducts the heat to the side wall 13, the side wall 13 may partially conduct the heat to the pot cover 2 to further even out the heating of the smoking material at different positions in the cavity 14.

Figure 7:
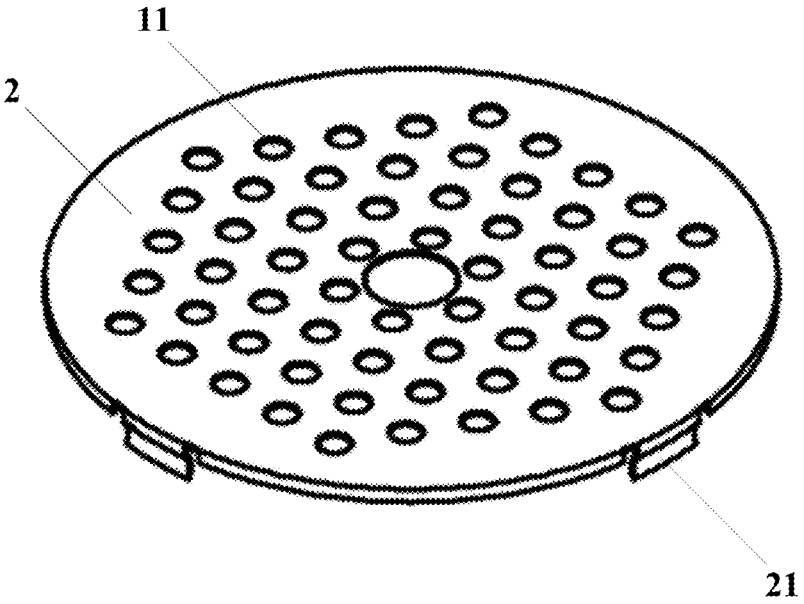
FIG. 7 is a schematic structural diagram of a pot cover of an atomizer pot according to the present disclosure.

In a specific embodiment, referring to FIG. 7, the pot cover 2 is provided with a plurality of air passing holes 11 in a direction opposite to the opening 141, so that the smoke can flow out of the atomizer pot 10 via the air passing holes 11. The shape and number of the air passing holes 11 and the interval between the air passing holes 11 are only an example of the air passing holes 11, which are not intended to limit the air passing holes 11. The shape and number of the air passing holes 11 and the interval between the air passing holes 11 may be adjusted based on a requirement of the atomizer pot 10.

Further, to ensure that the pot cover 2 can stably cover the opening 141, a plurality of engaging parts 21 are spaced apart at an edge of the pot cover 2. When the pot cover 2 covers the opening 141, the plurality of engaging parts 21 are engaged with a bottom edge of the pot body 1 far away from the top part 12. Preferably, the plurality of engaging parts 21 are symmetrically distributed on a bottom edge of the pot cover 2 facing the cavity 14.

In a specific embodiment, after the top part 12 of the atomizer pot 10 is heated, the heat of the heating device is transferred to the top part 12, the side wall 13 and the pot cover 2 to achieve uniform heating of the smoking material loaded in the cavity 14. When the top part 1 in the present disclosure is heated by the heating device, the smoking material is positioned above the pot cover 2, and the pot body 1 is positioned above the smoking material. That is, when the heating device heats the atomizer pot 10, the heating device, the pot body 1, the smoking material and the pot cover 2 are arranged in sequence from top to bottom.

Figure 4:
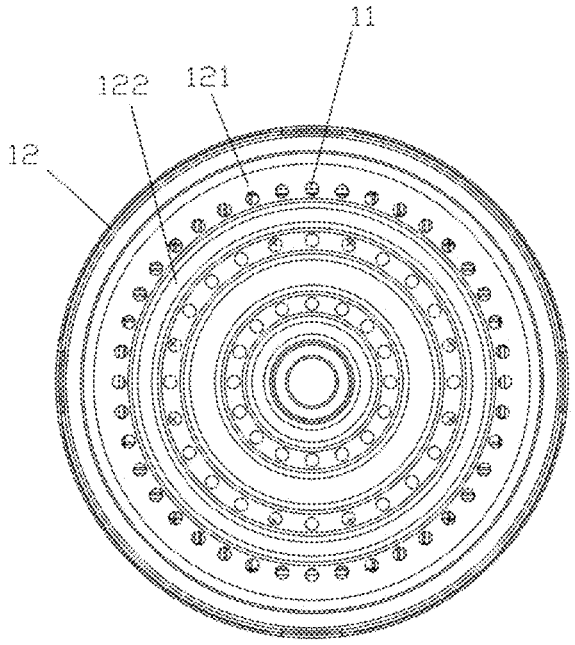
FIG. 4 is a schematic structural diagram of a top part of an atomizer pot according to the present disclosure.

The specific features of the top part are further described below to describe how excessive heating of the smoking material close to the heating device may be avoided. Referring to FIG. 4, since the top part 12 directly contacts a heat source, to avoid the situation that the smoking material close to the top part 12 is excessively heated, the top part 12 is provided with a plurality of annular convex parts 122 and a plurality of annular concave parts 121, and the top part 12 is provided with a plurality of air passing holes 11. Specifically, the concave parts 121 and the convex parts 122 are alternately arranged. The convex part 122 is a portion of the top of the atomizer pot 10 that protrudes away from the cavity 14 and directly contacts the heating device. Since the convex part 122 directly contacts the heating device, the air passing hole 11 is provided in the concave part 121. The concave part 121 provided with the air passing holes 11 has some gaps from the heating device to distribute the heat of the heating device uniformly to the top part 12 to allow air to enter the cavity 14 sufficiently. Meanwhile, the situation that the local excessive heating of the smoking material is caused by uneven air contact may be avoided. The convex part 122 and the concave part 121 in the present disclosure may be adjusted based on a shape of the pot body 1. For example, when the pot body 1 has a circular truncated cone shape as a whole, the convex part 122 and the concave part 121 may be provided in an annular shape.

In a specific embodiment, the convex part 122 is used to transfer heat, and the concave part 121 is used to intake air. The convex part 122 is used to transfer heat, the concave part 121 is used to intake air, and the air can be drawn through the concave part 121.

As an example, a plurality of convex parts 122 and a plurality of concave parts 121 are added to the top part 12, and a plurality of air passing holes 11 are provided on the top part 12, so that air can fully enter the atomizer pot 10 and the smoking material can be fully heated. The atomizer pot 10 provided by the present disclosure can also increase the contact area between the interior of the smoking material and external air, thereby making the heating inside the smoking material uniform.

Figure 5:
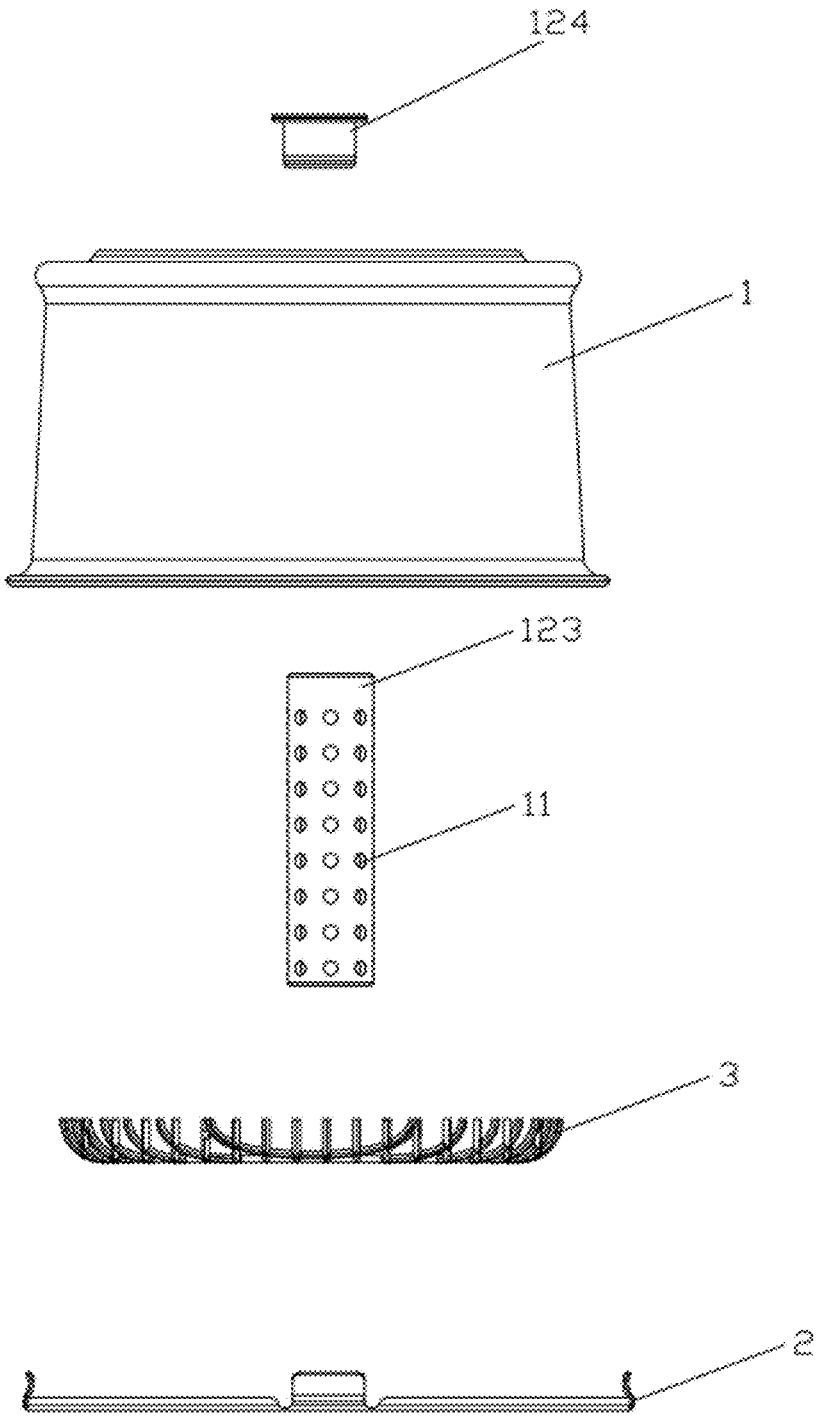
FIG. 5 is an exploded view of an atomizer pot according to an embodiment of the present disclosure.

Specific features of the atomizer pot 10 are further described below to describe how to further increase the contact area between the inside of the smoking material and the external air. Referring to FIG. 5, the atomizer pot 10 is further provided with an air passing pipe 123. The air passing pipe 123 is a hollow cylinder. The air passing pipe 123 is used to guide external air into the cavity 14 to contact the smoking material, so that the smoking material may be sufficiently heated. The air passing pipe 123 has one end connected to the top part 12 and another end extending away from the top part 12. In the present disclosure, the air passing pipe 123 and the smoking material are contained together in the cavity 14, and the air passing pipe 123 fully contacts the smoking material. The air passing pipe 123 is provided with a plurality of air passing holes 11 for the external air to contact the smoking material. When the smoking material is heated and atomized to generate smoke, air entering from the air passing hole 11 of the top part 12 can fully contact the interior of the smoking material through the air passing hole 11 of the air passing pipe 123, so that the contact area between the interior of the smoking material and the external air is increased, and the heating effect of the smoking material is improved.

In a specific embodiment, to facilitate disassembly and cleaning of the atomizer pot 10, a tail end of the air passing pipe 123 does not protrude from the side wall 13. Preferably, one end of the air passing pipe 123 is riveted to a center of the top part 12 by a rivet 124 to further increase the contact area between the air passing pipe 123 and the smoking material.

As an example, it is described that the contact area between the smoking material inside the cavity 14 and the external air is increased by the air passing pipe 123 to achieve the effect of increasing the heating of the smoking material. To avoid excessive heating of the smoking material, the atomizer pot 10 of the present disclosure also provides isolation between the top part 12 directly contacting the heat source and the smoking material. Specific features of the atomizer pot 10 are further described below to describe how to achieve isolation between the top part 12 and the smoking material.

Figure 6:
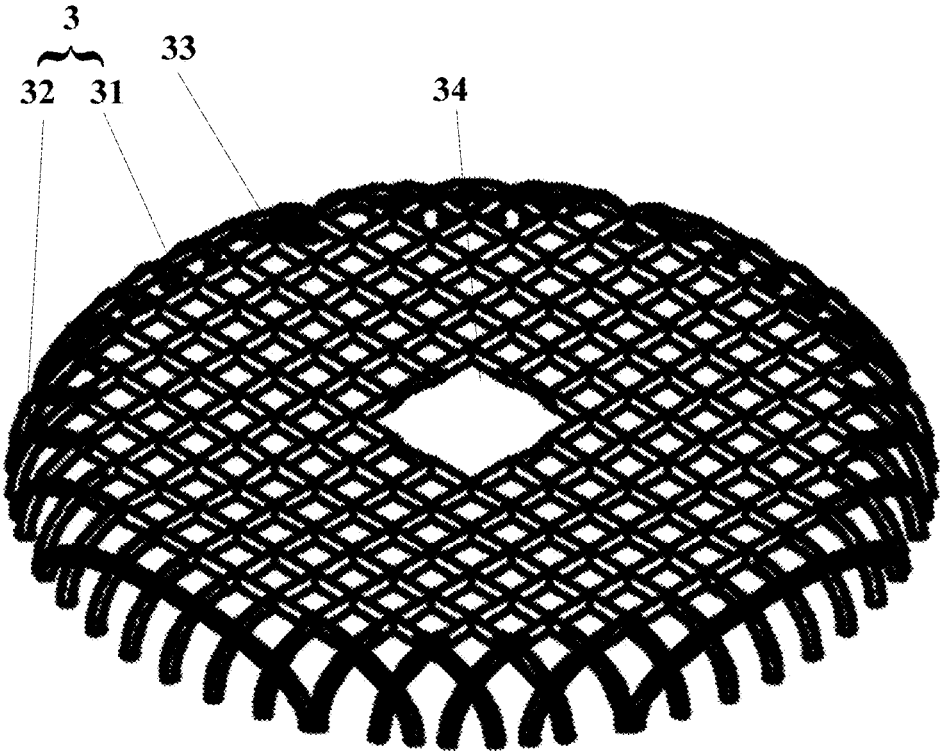
FIG. 6 is a schematic structural diagram of a mesh sheet of an atomizer pot according to the present disclosure.

Referring to FIG. 6, the atomizer pot 10 further includes a mesh sheet 3. The mesh sheet 3 is positioned in the cavity 14 and close to the top part 12. The mesh sheet 3 is made of stainless steel, so as to conduct heat generated by heating the top part 12 to the smoking material. Specifically, the edge of the mesh sheet 3 contacts the top part 12 and forms a gap between the rest of the mesh sheet 3 and the top part 12, and the heat received by the top part 12 is transferred from the edge of the mesh sheet 3 to the mesh sheet 3 and further to the smoking material close to the top part 12. The mesh sheet 3 only partially contacts the top part 12 to avoid the direct contact of the top part 12 and the smoking material, which is convenient for cleaning the pot body 1 and can avoid the probability that the smoking material close to the top part 12 is locally burnt due to uneven heating caused by overhigh temperature of the top part 12.

Further, the mesh sheet 3 has a grid-like arc-shaped structure. The mesh sheet 3 is provided with a mounting hole 34 so as to be sleeved on the air passing pipe 123 through the mounting hole 34. The mesh sheet 3 includes a mesh bottom 31 provided opposite to the top part 12, and a mesh edge 32 extending obliquely from the mesh bottom 31 toward the top part 12. The mesh bottom 31 is provided with a plurality of arc-shaped through holes 33. A plurality of arc-shaped through holes 33 are used to increase the contact area between the smoking material and the air, thereby improving the heating efficiency of the smoking material. The edge of the mesh sheet 3 is the edge of the mesh edge 32. Since one end of the air passing pipe 123 is riveted to the center of the top part 12 by the rivet 124, the mounting hole 34 is also provided in the mesh sheet 3 corresponding to the center of the top part 12.

In the above embodiment, the top part 12 is isolated from the smoking material by the mesh sheet 3 arranged in the cavity 14 close to the top part 12, thereby further reducing excessive heating of the smoking material. The heating conditions of different loading of the smoking material are described by the following specific examples.

Figure 8:
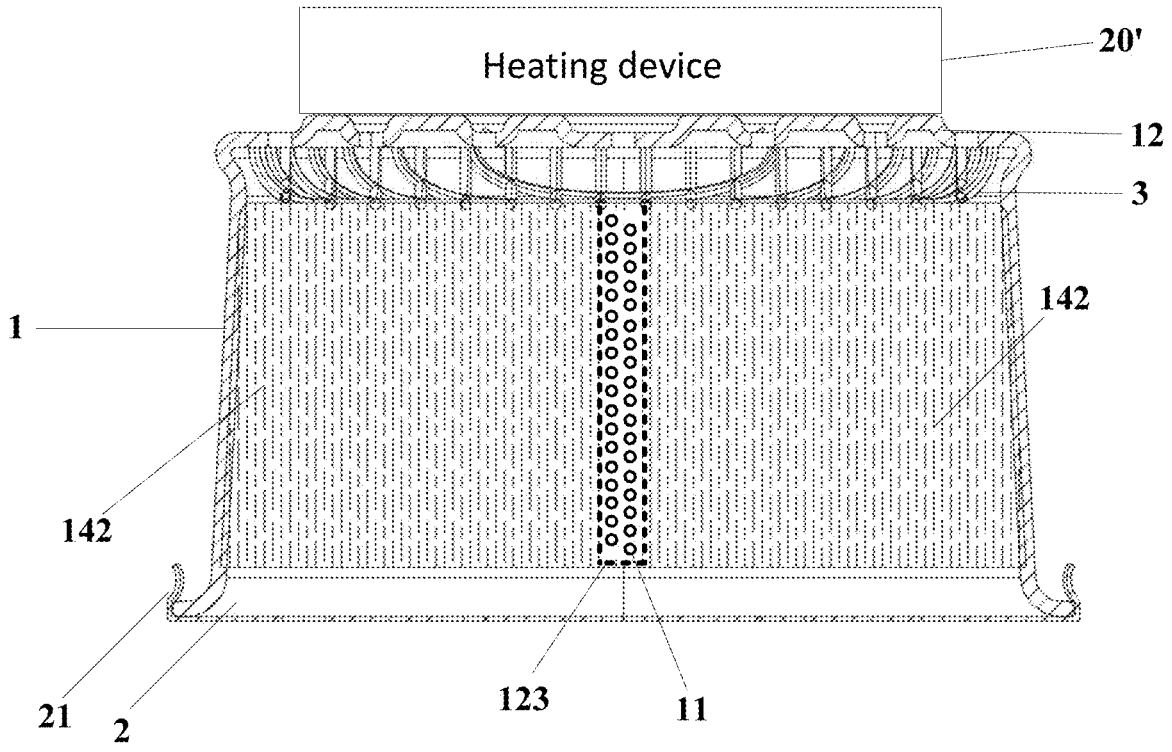
FIG. 8 is a schematic diagram of a heating scene of an atomizer pot according to the present disclosure.

FIG. 8 is a schematic diagram of a heating scene of an atomizer pot according to an embodiment of the present disclosure, and the pot body 1 is in a circular truncated cone shape as a whole. The size of the side wall 13 gradually increases from the top part 12 to the bottom. Along an axial direction parallel to the top part 12, a cross-sectional area of the top 12 is less than that of the pot cover 2. During the heating of the atomizer pot 10 by the heating device 20', the top part 12 is opposite to the heating device 20'. The heating device 20' and the atomizer pot 10 are configured as the heating device 20', the top part 12, the pot body 1 and the pot cover 2 from top to bottom. In the present disclosure, the smoking material 142 is loaded in the cavity 14 in the form of smoking paste. When the smoking material 142 is not fully loaded in the cavity 142, a vertical height of the smoking material 142 from the top part 12 is less than that of the top part 12 to the pot cover 2; that is, the smoking material 142 can only contact one of the top part 12 and the pot cover 2, and the smoking material 142 contacts the side wall 13 matching the shape of the cavity 14 and the side wall 13. When the top part 12 is heated by the heating device 20', the smoking material 142 adapts to the shape of the cavity 14 and directly contacts the mesh sheet 3 and the side wall 13 to be fully heated. When the smoking material 142 is fully loaded in the cavity 14 and the top part 12 is heated by the heating device 20', the smoking material 142 receives heat from the mesh sheet 3, the side wall 13 and the pot cover 2 and is heated sufficiently, and the local heating of the smoking material close to the top part 12 is slowed down without burning.

In the above embodiment, the heating of the atomizer pot 10 under different loading conditions of the smoking material 142 is described. How to mount the atomizer pot 10 is described below.

Figure 9:
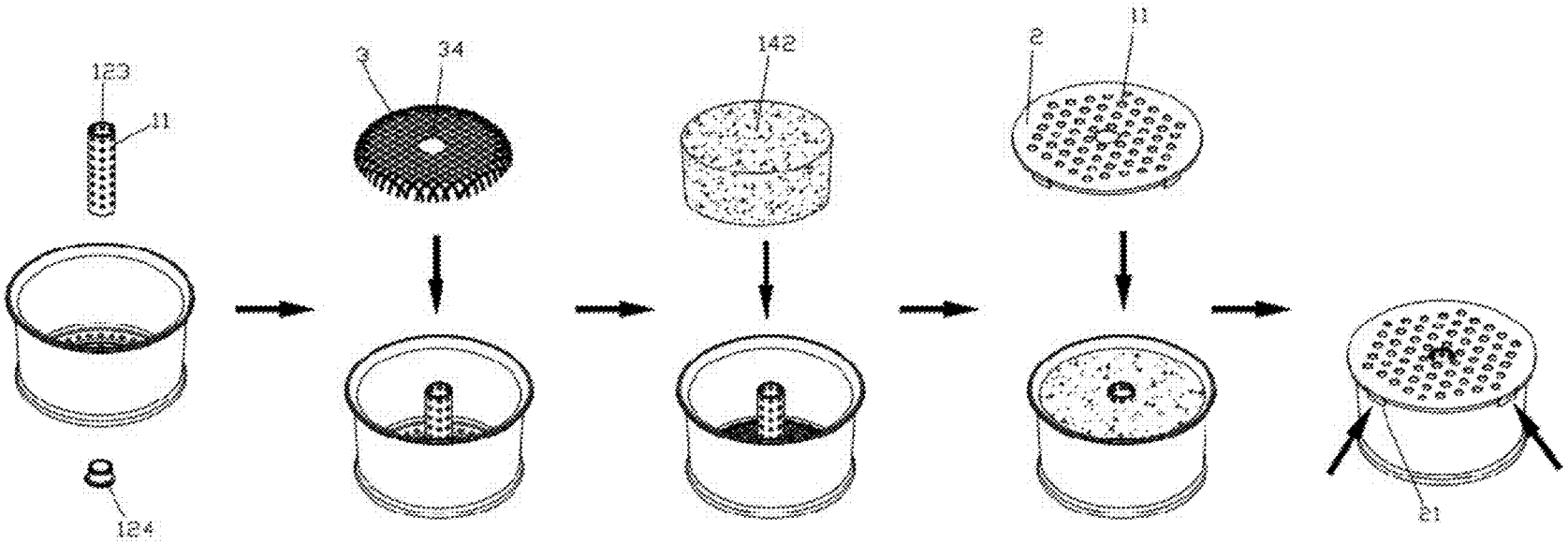
FIG. 9 is a schematic diagram of the mounting steps of an atomizer pot according to the present disclosure.

FIG. 9 is a schematic diagram of the mounting steps of an atomizer pot according to the present disclosure. The mounting steps of the atomizer pot 10 are as follows: firstly, riveting an air passing pipe 123 at a center of the top part 12 by using a rivet 124, keeping the air passing pipe 123 not protruding out of the side wall 13 and enabling a plurality of air passing holes 11 to be positioned in the cavity 14; then, sleeving the mesh sheet 3 on a heat conducting air pipe 134 by the mounting hole 34, so that the mesh edge 32 contacts the top part 12 and the mesh bottom 31 is far away from the top part 12 relative to the top part 12; placing the smoking material 142 adapted to the shapes of the mesh sheet 3, the top part 12 and the cavity 14 on the mesh bottom 31, so that the mesh sheet 3 supports the smoking material 142 to be contained in the cavity 14; covering the pot cover 2 on the side wall 13, so that the engaging part 21 faces the cavity 14; and finally, locking the engaging part 21 at the bottom of the side wall 13, so that the atomizer pot 10 is mounted. Similarly, the disassembling steps of the atomizer pot 10 may be deduced according to the mounting steps of the atomizer pot 10, so that the cleaning of all components in the atomizer pot 10 is facilitated.

Figure 10:
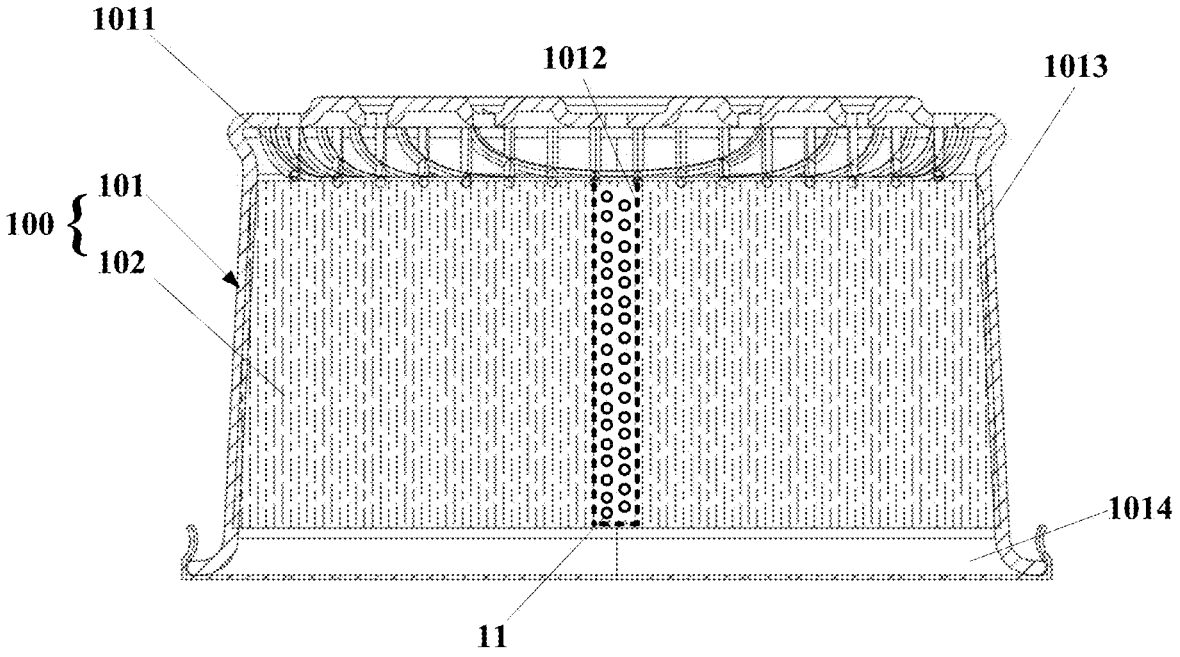
FIG. 10 is a cross-sectional view of a smoking material pot of an atomizer pot according to the present disclosure.

FIG. 10 is a cross-sectional view of a smoking material pot according to an embodiment of the present disclosure. The present disclosure further provides a smoking material pot 100. The smoking material pot 100 includes an atomizer pot 101 and a smoking material 102. The smoking material 102 is placed in the atomizer pot 101. The smoking material pot 100 is mounted on the electronic hookah for the user to inhale the smoke generated by the smoking material 102. The structure of the atomizer pot 101 in the present disclosure is the same as that of the atomizer pot 10. Details are not described herein again. The smoking material 102 can be automatically loaded into the atomizer pot 101 by an automatic filling device (not shown). Specifically, firstly, an automatic filling device fills the smoking material 102 into the pot body 1013 provided with the mesh sheet 1011 and the air passing pipe 1012; then, after the filling of the smoking material 102 is completed, the pot cover 1014 is covered on the bottom part of the pot body 1013 by an automatic filling device or manually. In this case, the processing of the smoking material pot 100 is completed. That is to say, the atomizer pot 101 with a detachable pot cover 1014 can achieve the standardization of smoking material and greatly improve the efficiency of smoking material filling. When the user uses the electronic hookah, if the smoking material 102 is consumed, the smoking material pot 100 may be directly replaced, which is more convenient for the user.

Figure 11:
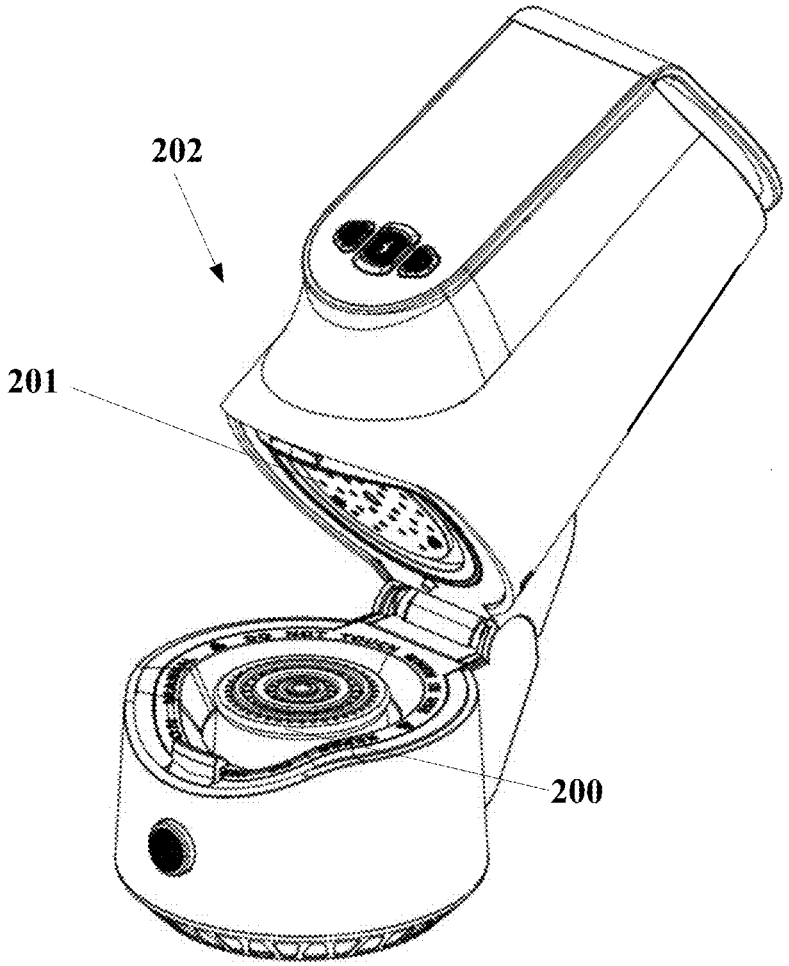
FIG. 11 is a schematic diagram of a main unit of an electronic hookah with an atomizer pot according to the present disclosure.
Figure 12:
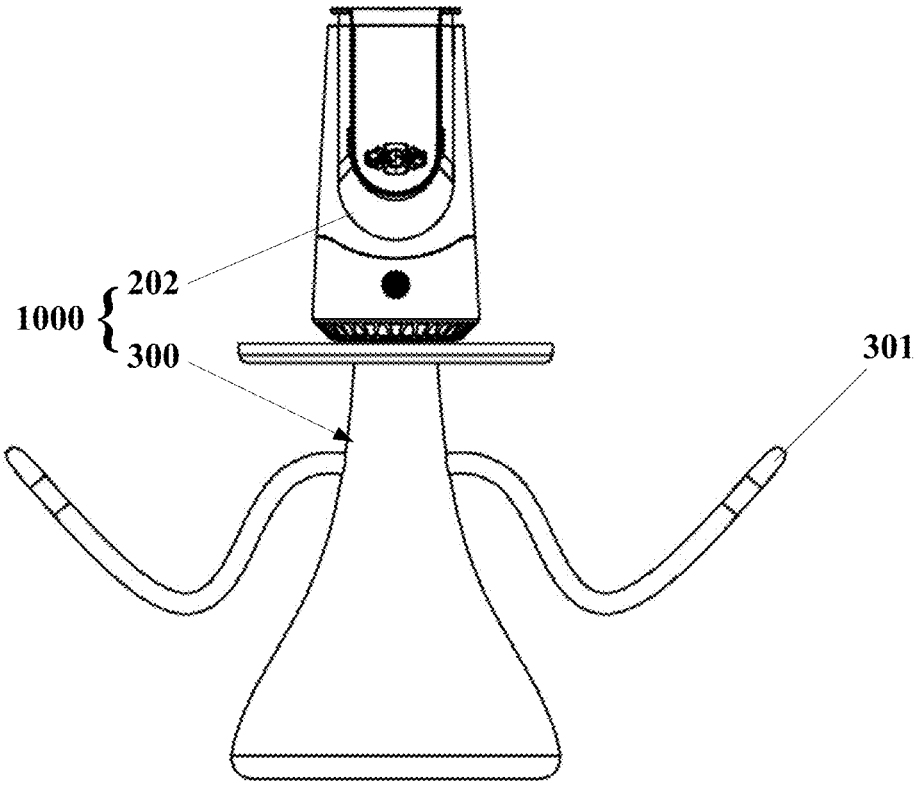
FIG. 12 is a schematic diagram of an electronic hookah with an atomizer pot according to the present disclosure.

Referring to FIGS. 11 and 12, FIGS. 11 and 12 are schematic diagrams of a main unit of an electronic hookah and an electronic hookah, respectively. The present disclosure further provides an electronic hookah 1000. The electronic hookah 1000 includes a main unit 202. The main unit 202 is provided with an air outlet hole. The main unit 202 may be externally connected to a container 300 through the air outlet hole. The container 300 is filled with edible filtrate and provided with a straw for suction. The straw is provided with a mouthpiece 301 for the user to inhale. The electronic hookah 1000 further includes an electric heating component 201 provided on the main unit 202, and an atomizer pot 200 detachably mounted on the main unit 202. The atomizer pot 200 is used to mount the smoking material 142. The atomizer pot 200 is heated by the electric heating component 201 as a heating device to heat the smoking material to form smoke. The smoke is output from the air outlet hole to the container 300 for the user to inhale via the mouthpiece 301. The structure of the atomizer pot 200 in the present disclosure is the same as that of the atomizer pot 10. Details are not described herein again. The electric heating component 201 is provided with a heating chamber for mounting the atomizer pot 200, and when the atomizer pot 200 is mounted to the heating chamber, the electronic hookah 1000 is sequentially provided with the electric heating component 201, a pot body, a smoking material and a pot cover from top to bottom. To keep the top part 12 of the atomizer pot 200 heated by the electric heating component 201, the smoking material 142 is positioned above the pot cover 2, and the pot body 1 is positioned above the smoking material 142, that is, FIG. 9 is placed upside down.

In the above embodiment, the pot cover 2 may be detachably mounted on the pot body 1, which is convenient for loading the smoking material and cleaning the atomizer pot 10. Meanwhile, when the atomizer pot 10 is heated, the pot cover 2 is at the bottom and the pot body 1 is at the top, the pot body 1 is heated, the atomizer pot 10 is heated upside down, and the smoking material 142 does not need to be directly exposed to high temperature and is not easy to burn.

Although preferred embodiments of the present disclosure have been described, additional changes and modifications may be made to these embodiments once those skilled in the art are aware of the basic inventive concepts. Therefore, it is intended that the appended claims be interpreted as including the preferred embodiment and all changes and modifications that fall within the scope of the embodiments of the present disclosure.

Finally, it is noted that, in the present disclosure, relational terms such as "first" and "second" are merely used to distinguish one entity or operation from another entity or operation without necessarily requiring or implying any actual relationship or order between such entities or operations. Moreover, terms "include", "comprise", or any other variants thereof are intended to cover a non-exclusive inclusion, so that a process, a method, an article, or a terminal device that includes a list of elements includes those elements, and also includes other elements which are not expressly listed, or further includes elements inherent to this process, method, article, or terminal device. An element preceded by "includes a . . . " does not, without more constraints, preclude the existence of additional identical elements in the process, method, article, or terminal device that includes the element.

The above is a detailed introduction to an atomizer pot, a smoking material pot and an electronic hookah provided by the present disclosure. The principle and implementation of the present disclosure are described herein by using specific examples. The descriptions about embodiments of the present disclosure are merely provided, to help understand the method and core ideas of the present disclosure. In addition, those of ordinary skill in the art can make variations and modifications to the present disclosure in terms of the specific implementations and application scopes according to the ideas of the present disclosure. Therefore, the content of specification is not construed as a limit to the present disclosure.

What is claimed is:

1. An atomizer pot, comprising: a pot body and a pot cover adapted to the pot body;

the pot body and the pot cover form a cavity for containing a smoking material; the pot body and the pot cover are both provided with a plurality of air passing holes; the pot body is made of a thermally conductive material; the pot body comprises a top part, a side wall extending around an edge of the top part, and a bottom part opposite to the top part, and the pot cover is provided at the bottom part;

the atomizer pot further comprising a heat-relief sheet provided at the top part inside the pot body, wherein the heat-relief sheet is in the form of a mesh sheet, the mesh sheet comprises a mesh bottom provided opposite to the top part, and a mesh edge extending obliquely from the mesh bottom toward the top part, the mesh edge is in contact with the top part, a gap is formed between a remaining part of the mesh sheet and the top part, the mesh bottom is provided with a plurality of arc-shaped through holes, the plurality of arc-shaped through holes are configured to increase contact area between the smoking material and hot air, thereby improving heating efficiency of the smoking material, and the mesh sheet has a grid-like arc-shaped structure;

the atomizer pot further comprising an air passing pipe, wherein the air passing pipe is provided in the cavity and connected to the top part, the mesh sheet is provided with a mounting hole, and the mesh sheet is sleeved on the air passing pipe through the mounting hole;

wherein the top part is provided with a heat distribution structure, the heat distribution structure comprises a plurality of annular convex parts and a plurality of annular concave parts, a height of the plurality of annular convex parts is greater than that of the plurality of annular concave parts, the plurality of annular convex parts and the plurality of annular concave parts are alternately arranged, the plurality of air passing holes are provided in the plurality of annular concave parts, the plurality of annular convex parts are configured for transferring heat and the plurality of annular concave parts are configured for intaking the hot air; when the atomizer pot is heated, the smoking material is insulated by the pot body, and the hot air enters the smoking material from the air passing holes.

2. The atomizer pot according to claim 1, wherein a shape of the heat-relief sheet is adapted to that of the pot body.

3. The atomizer pot according to claim 1, wherein the heat-relief sheet is arranged around the air passing pipe.

4. The atomizer pot according to claim 1, wherein the pot body has a thickness of 0.4-3 mm.

5. The atomizer pot according to claim 1, wherein the pot body has a thermal conductivity of 20-600 W/(m.K).

6. The atomizer pot according to claim 1, wherein the side wall and the top part a define the cavity for containing the smoking material.

7. The atomizer pot according to claim 1, wherein the pot cover is detachably mounted at one end of the side wall, the pot cover covers an opening of the pot body, and the top part is configured to be heated to generate heat.

8. The atomizer pot according to claim 1, wherein a shape of the heat-relief sheet is adapted to that of the top part.

9. An electronic hookah, comprising a main unit and the atomizer pot according to claim 1, wherein the atomizer pot is arranged in the main unit.

10. An electronic hookah, comprising a main unit and the atomizer pot according claim 2, wherein the atomizer pot is arranged in the main unit.

11. An electronic hookah, comprising a main unit and the atomizer pot according to claim 3, wherein the atomizer pot is arranged in the main unit.

12. An electronic hookah, comprising a main unit and the atomizer pot according to claim 4, wherein the atomizer pot is arranged in the main unit.

13. An electronic hookah, comprising a main unit and the atomizer pot according to claim 5, wherein the atomizer pot is arranged in the main unit.

14. An electronic hookah, comprising a main unit and the atomizer pot according to claim 8, wherein the atomizer pot is arranged in the main unit.

* * * * *